US006389972B2

(12) United States Patent
Duvacquier et al.

(10) Patent No.: US 6,389,972 B2
(45) **Date of Patent: *May 21, 2002**

(54) ELECTRO-PYROTECHNIC INITIATOR BUILT AROUND A COMPLETE PRINTED CIRCUIT

(75) Inventors: Daniel Duvacquier, Bordeaux; Christian Perotto, Ballancourt, both of (FR)

(73) Assignee: Livbag S.N.C., Vert le Petit (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/038,931

(22) Filed: Mar. 9, 1998

(30) Foreign Application Priority Data

Mar. 7, 1997 (FR) ..... 97 02715

(51) Int. Cl.[7] ..... F42B 3/18

(52) U.S. Cl. ..... 102/202.2; 102/202.7; 102/202.14; 102/530; 280/741

(58) Field of Search ..... 102/202.2, 202.5, 102/202.7, 530, 202.1, 202.3, 202.9, 202.14, 531, 202.11; 280/741, 736

(56) References Cited

U.S. PATENT DOCUMENTS

| | | | | | |
|---|---|---|---|---|---|
| 3,717,096 | A | * | 2/1973 | Ward | 102/202.11 |
| 3,735,705 | A | * | 5/1973 | Hudson, Jr. et al. | 102/202.2 |
| 3,804,018 | A | * | 4/1974 | Janoski | 102/202.1 |
| 4,040,356 | A | * | 8/1977 | Voreck, Jr. et al. | 102/202.2 |
| 4,145,970 | A | * | 3/1979 | Hedberg et al. | 102/218 |
| 4,350,096 | A | * | 9/1982 | Cannavo et al. | 102/202.5 |
| 4,380,958 | A | * | 4/1983 | Betts | 102/202.2 |
| 4,690,056 | A | | 9/1987 | Brede et al. | |
| 4,712,477 | A | * | 12/1987 | Aikou et al. | 102/202.5 |
| 4,722,551 | A | | 2/1988 | Adams | |
| 4,730,558 | A | * | 3/1988 | Florin et al. | 102/202.7 |
| 4,788,913 | A | * | 12/1988 | Stroud et al. | 102/202.5 |
| 4,819,560 | A | * | 4/1989 | Patz et al. | 102/202.5 |
| 4,852,493 | A | * | 8/1989 | Boberg et al. | 102/202.5 |
| 4,862,803 | A | * | 9/1989 | Nerheim et al. | 102/202.5 |
| 4,869,170 | A | * | 9/1989 | Dahmberg et al. | 102/202.5 |
| 5,080,016 | A | * | 1/1992 | Osher | 102/202.7 |
| 5,099,762 | A | * | 3/1992 | Drapala | 102/202.2 |
| 5,309,841 | A | * | 5/1994 | Hartmann et al. | 102/202.5 |
| 5,337,674 | A | * | 8/1994 | Harris et al. | 102/202.7 |
| 5,355,800 | A | | 10/1994 | Dow et al. | |
| 5,544,585 | A | | 8/1996 | Duguet | |
| 5,634,660 | A | * | 6/1997 | Fink et al. | 280/741 |
| 5,821,446 | A | * | 10/1998 | Chatley, Jr. | 102/202.7 |
| 5,847,309 | A | * | 12/1998 | Baginski | 102/202.2 |
| 5,889,228 | A | * | 3/1999 | Ewick et al. | 102/202.5 |
| 6,079,332 | A | * | 6/2000 | Marshall et al. | 102/202.5 |

FOREIGN PATENT DOCUMENTS

| | | | |
|---|---|---|---|
| EP | 0 279 796 | | 8/1988 |
| EP | 512 682 | | 11/1992 |
| EP | 0 609 605 | | 8/1994 |
| GB | 2 019 198 | | 10/1979 |
| GB | 2 123 122 | | 1/1984 |
| GB | 2 198 816 | | 6/1988 |
| WO | WO97/21067 | * | 6/1997 |

* cited by examiner

*Primary Examiner*—Harold J. Tudor
(74) *Attorney, Agent, or Firm*—Pillsbury Winthrop LLP

(57) ABSTRACT

The invention relates to an initiator for a pyrotechnic gas generator intended for motor vehicle safety. The initiator (2) is built from a circuit support (10) on which conductive strips are printed which include electromagnetic protection and the ends of which are joined together by a resistive element covered with a thermosensitive charge (6). The conductive strips are connected to an electric cable (3). The support (10) is coated in a cylindrical overmoulded insulation (4, 5). A fragmentable cylindrical cap (8) containing an igniter composition (9) forms, together with the initiator (2), an igniter (1) for pyrotechnic generators intended for motor vehicle safety.

1 Claim, 4 Drawing Sheets

ELECTRO-PYROTECHNIC INITIATOR BUILT AROUND A COMPLETE PRINTED CIRCUIT

FIELD OF THE INVENTION

Description of Related Art

The present invention relates to the field of pyrotechnic initiators and deals more specifically with an electro-pyrotechnic initiator intended for motor vehicle safety.

Electro-pyrotechnic initiators are traditionally built from two electrically conducting pins which are held in place by overmoulded insulation and the upper ends of which are joined together by a heating resistive filament which is encased in an igniter bead consisting of a primary explosive such as lead trinitroresorcinate or lead styphnate and the lower ends of which are connected to a source of electrical current.

Such electro-pyrotechnic initiators are widely used to form devices for igniting pyrotechnic gas generators intended to inflate air bags to protect the occupants of a motor vehicle. In order to protect these initiators against parasitic electrostatic currents and avoid untimely undesired and possibly dangerous ignition, a ferrite core is generally placed between the pins, as described, for example, in the Patents U.S. Pat. No. 4,722,551 and EP-A-0,512,682. In order further to improve the ignition reliability, the heating resistive filament is sometimes replaced by a printed circuit comprising a resistive and heating part as described, for example, in Patent Application FR-A-2,704,944 or in its counterpart U.S. Pat. No. 5,544,585.

Whatever the case may be, systematically resorting to conductive pins appreciably increases the cost price and the complexity of manufacturing these electro-pyrotechnic initiators. What is more, the very frequent use of ferrite cores increases the external dimensions of the overmoulding surrounding the pins and does nothing to help reduce the overall volume of the pyrotechnic gas generators intended for motor vehicle safety.

Those skilled in the art are therefore still looking for electro-pyrotechnic initiators which are at the same time reliable in their operation, easy and economical to manufacture and small in volume.

BRIEF SUMMARY OF THE INVENTION

The object of the present invention is specifically to provide such an initiator by dispensing with the pins and the ferrite cores and by integrating their functions into a complete printed circuit, contrary to all that has been done hitherto.

The invention therefore relates to an electro-pyrotechnic initiator connected to an electric cable consisting of two conductive wires and comprising:

i) a thermosensitive charge that can be initiated by a heating resistive element, ii) an electric circuit connecting the said resistive element to the said conductive wires, iii) means of electromagnetically protecting the said electric circuit, characterized in that the said heating resistive element, the said electric circuit and the said means of electromagnetic protection are integrated into a circuit of conductive strips which are soldered to the said conductive wires and which are formed on a printed circuit support around which the said initiator is built.

The printed circuit support will normally consist of one of the insulating substances conventionally used for making such supports.

According to a first preferred embodiment of the invention, the said heating resistive element itself consists of a resistive strip formed on the printed circuit support and the thermosensitive charge is deposited on the said resistive strip.

The means of electromagnetically protecting the initiator against parasitic currents may consist of at least one filtering coil placed on the said circuit support. As a preference, in this case, the filtering coil may itself be printed on the said circuit support and, together with the electrical circuit, constitute a multi-layer printed circuit.

The said means of electromagnetic protection may alternatively consist of at least one capacitor arranged on the said circuit support.

According to a preferred embodiment of the invention, the said electric circuit and the said means of electromagnetic protection are covered by a layer of insulating varnish.

The circuit support, which may or may not be covered with a layer of insulating varnish, will moreover be partially coated with overmoulded insulation so that only that part of the circuit support that carries the heating resistive element covered with the thermosensitive charge is left free. When the thermosensitive charge is not itself at least partially held in place by the said overmoulding, it will advantageously be protected by a fragmentable mask. A mask made of very thin metal or a mask made of plastic, for example of transparent plastic, are suitable.

According to a second preferred embodiment of the invention, the said circuit support is in the form of a thin parallelepipedal card with two opposite flat faces. This second embodiment of the invention makes it possible to build electro-pyrotechnic initiators in which a separate circuit of conductive strips, each including a heating resistive element covered by a thermosensitive charge and means of electromagnetic protection is printed on each of the two flat faces of the circuit support. It is thus possible to build an initiator which, for a single electrical source, has two separate igniter heads and which is particularly dependable and reliable.

The invention also relates to an electro-pyrotechnic igniter, characterized in that an initiator according to the invention is surrounded by a fragmentable cap containing a granular igniter powder.

The invention finally relates to the use of an electro-pyrotechnic initiator according to the invention to ignite a pyrotechnic generator of gas 95 intended to inflate an air bag 96 to protect the occupant of a motor vehicle. The initiator may be used directly to ignite the pyrotechnic charge of the generator when the latter is in granular or pellet form, it will advantageously be used via an igniter like the one described above when the charge is in the form of a compact block.

The invention thus makes it possible, using small printed circuits which are very simple and very economic to produce, to construct initiators or igniters which are not very bulky and are very reliable.

BRIEF DESCRIPTION OF THE DRAWINGS

A preferred embodiment of the invention will be described hereinbelow with reference to FIGS. 1 to 8.

DETAILED DESCRIPTION OF THE INVENTION

Figure 1:
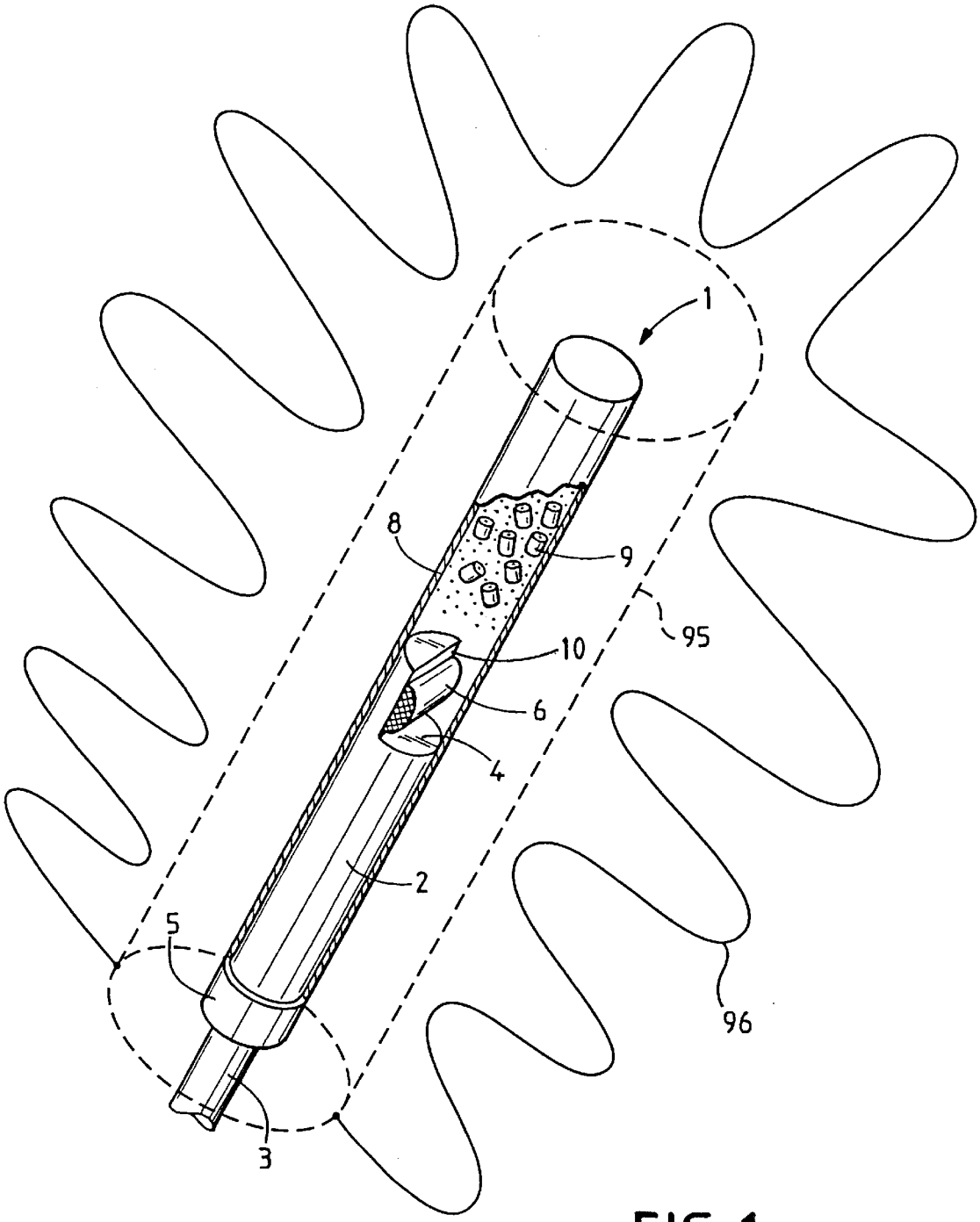
FIG. 1 is a view in perspective, with partial cutaway, of an igniter built from an initiator according to the invention depicted, for the sake of clarity, without its protective mask.
Figure 2:
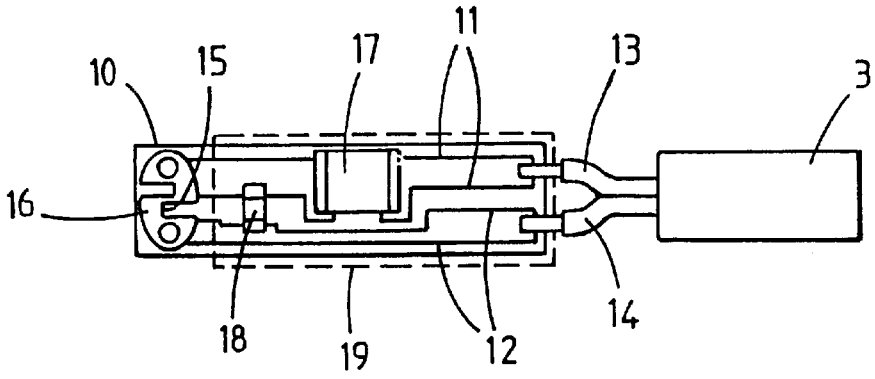
FIGS. 2, 3 and 4 illustrate the successive stages in building an initiator according to the invention starting with its circuit support.

FIG. 1 depicts an igniter 1 consisting of an initiator 2 connected to an electric cable 3.

Figure 4:
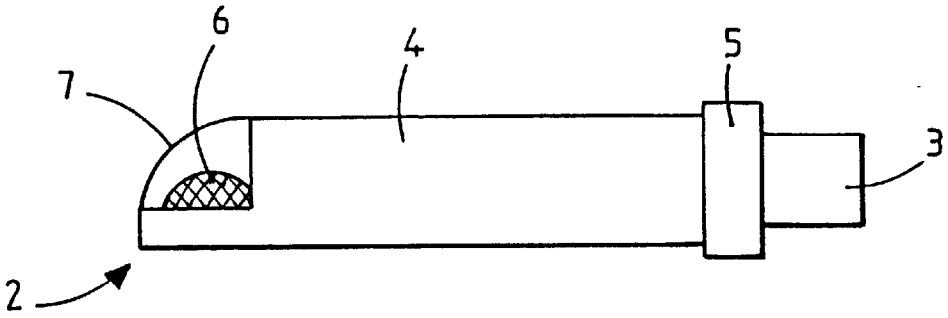
Figure 5:
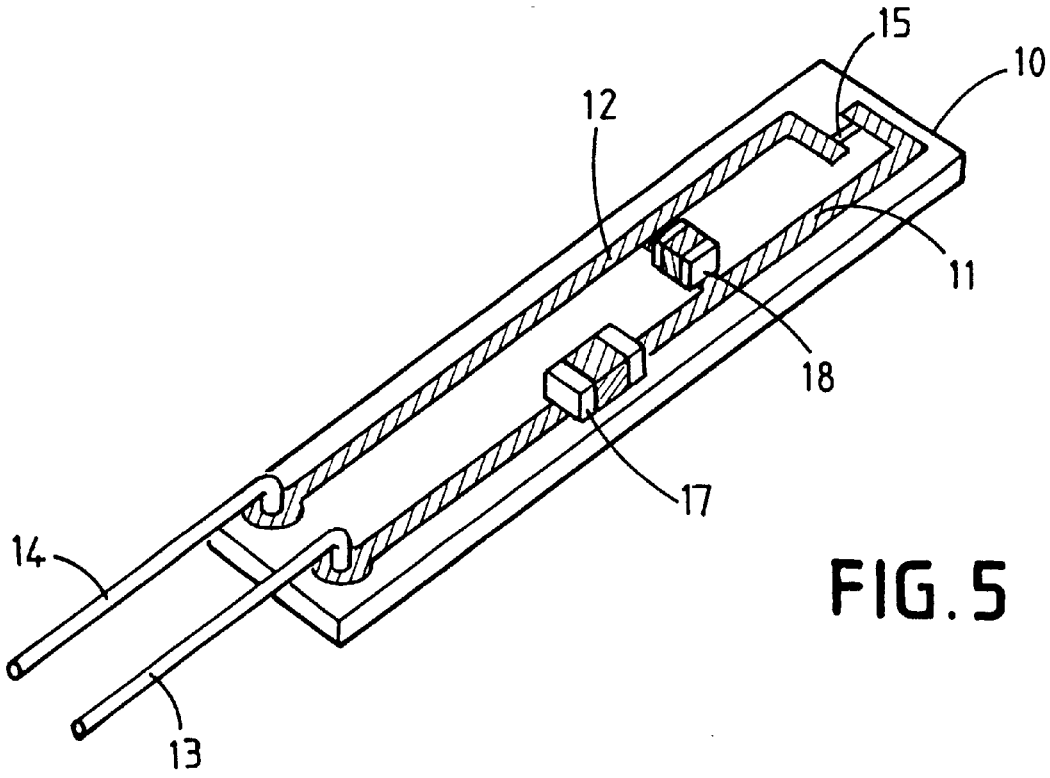
FIG. 5 illustrates a printed circuit in which the electromagnetic protection is provided by capacitors.

Referring more specifically to FIGS. 1 and 4, it can be seen that the initiator 2 is contained for the most part in a cylindrical overmoulding 4 which at the same end as the cable 3 has a base 5 of slightly larger diameter.

At its opposite end to the base 5, the initiator 2 has an igniter head which will be described in detail a little later but which can be seen to have a thermosensitive charge 6 based on lead trinitroresorcinate, which is protected by a mask 7 made of transparent plastic, not depicted in FIG. 1. A fragmentable metal cap 8 of cylindrical shape encases the overmoulding 4, resting against the base 5. This cap is closed at its opposite end to the base 5 and contains a pyrotechnic charge 9 which generates gas. A mixture of powder of the boron/potassium nitrate type, and of single-base nitrocellulose powder is ideal.

The construction of the initiator 2 will now be described in detail with reference more particularly to FIGS. 2 to 5. The initiator 2 is built from a printed circuit support 10 which is in the form of a thin parallelepipedal card with two opposite flat faces. This support 10 is built from an epoxy resin filled with glass fibres. Printed on one of its faces are two conductive strips 11 and 12, each of which is soldered at one of its ends to the conductive wires 13 and 14 that constitute the electric cable 3. A heating resistive element 15 joins the free ends of the conductive strips 11 and 12 together. This heating resistive element 15 may be a resistive wire but will advantageously consist of a heating resistive strip defined by a printed sub-circuit 16 as described in U.S. Pat. No. 5,544,585, the description of which is included, by reference, in this description.

The heating resistive element 15 could equally consist of a diode or of a semiconductor bridge as described, for example, in Patent Application FR-A-2,720,493.

Two capacitors 17 and 18 are arranged on and connected to the circuit formed by the conductive strips 11 and 12 and by the resistive element 15. These capacitors constitute the means of electromagnetically protecting the circuit by preventing the discharge of parasitic currents through the element 15.

Figure 6:
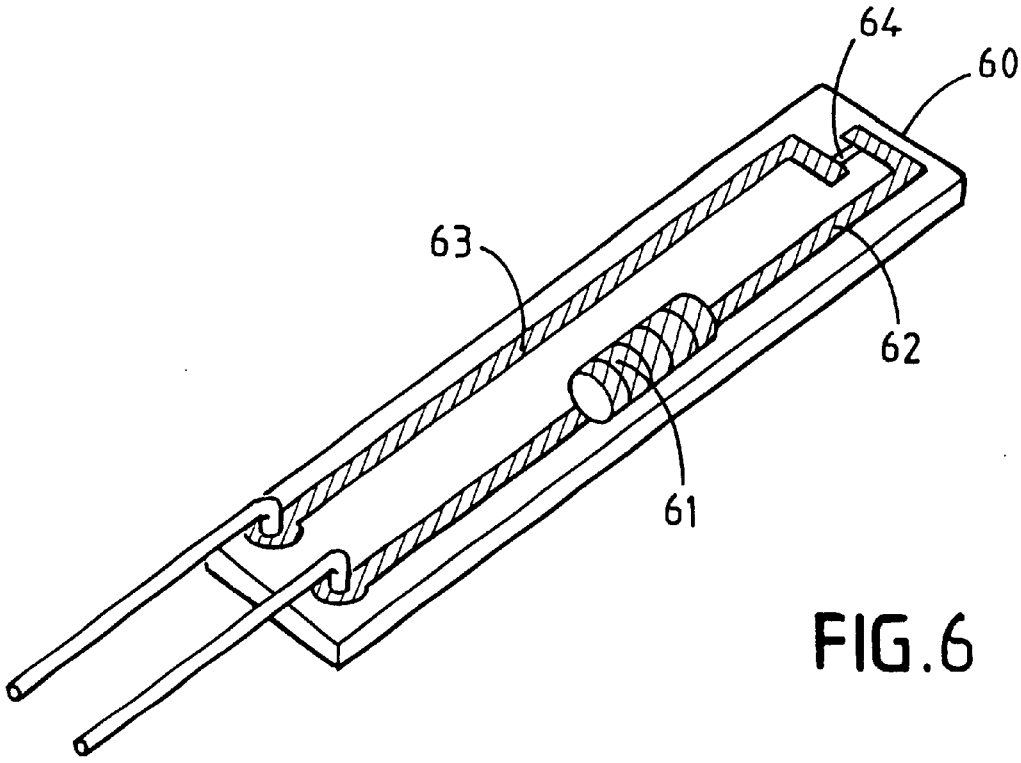
FIG. 6 illustrates a printed circuit in which the electromagnetic protection is provided by a conventional filtering coil.
Figure 7:
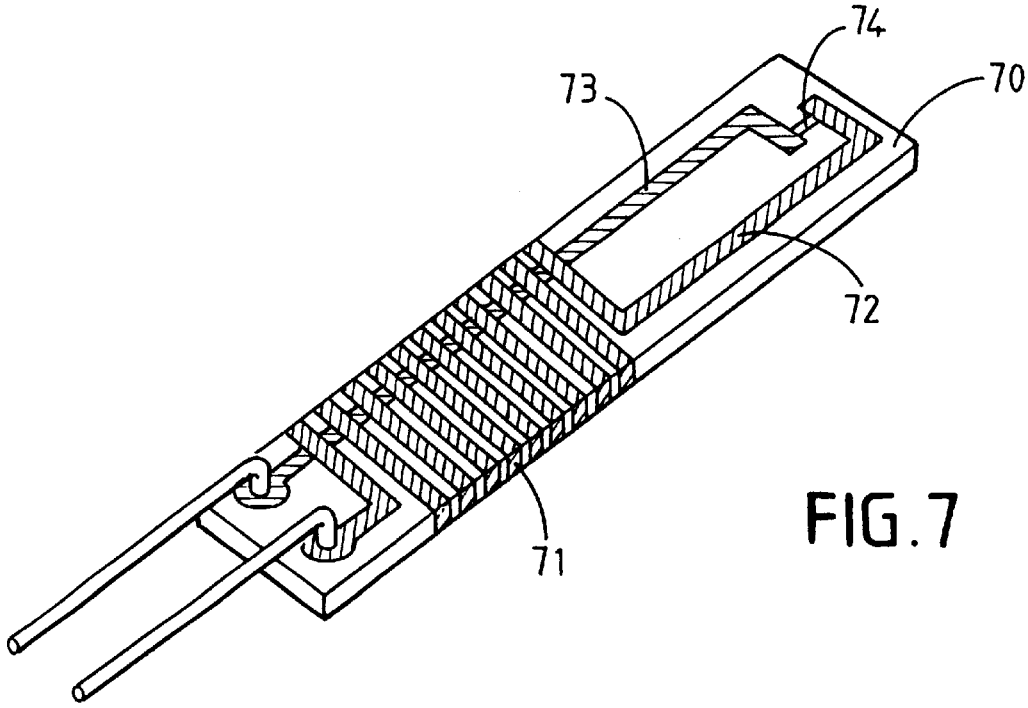
FIG. 7 illustrates a printed circuit in which the electromagnetic protection is provided by a coil printed in a multi-layer circuit.

These means of electromagnetic protection could also consist of a filtering coil 61 arranged on and connected to a circuit printed on a support 60 and consisting of two conductive strips 62 and 63 joined together by a resistive element 64 as depicted in FIG. 6. An alternative embodiment of electromagnetic protection of this kind is depicted in FIG. 7. A circuit that consists of two conductive strips 72 and 73 joined together by a resistive element 74 is printed on a support 70. The conductive strip 72 forms a coil 71 around the support 70, thus forming a multi-layer circuit with the strip 73.

Referring once again to FIG. 2, it can be seen that the part of the face of the support 10 on which the strips 11 and 12 are printed and on which the capacitors 17 and 18 rest is covered with a layer of insulating varnish 19. This layer 19 does not cover that end of the support 10 that carries the resistive element 15 and that will constitute the igniter head of the initiator. Thus prepared, the support 10 is partially surrounded by a cylindrical overmoulding 4 of adhesive resin based on a hot-melt polyamide.

Figure 3:
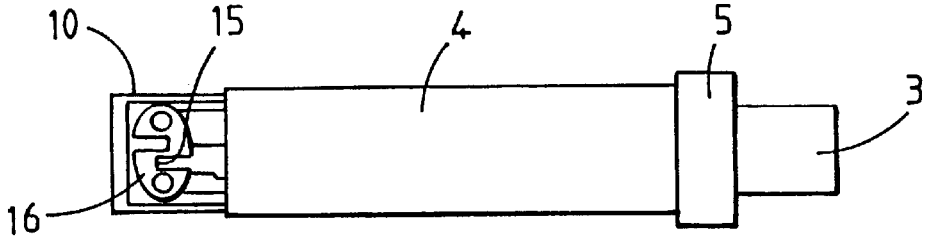

This overmoulding 4 leaves free that surface of the support 10 which carries the resistive element 15, as depicted in FIG. 3. This resistive element 15, together with the sub-circuit 16 used to form it are covered with a thermosensitive charge 6, for example based on lead trinitroresorcinate. The charge 6 is protected by a mask 7 made of transparent plastic. The initiator 2 is thus finished and can be used to form the igniter 1 described earlier.

Figure 8:
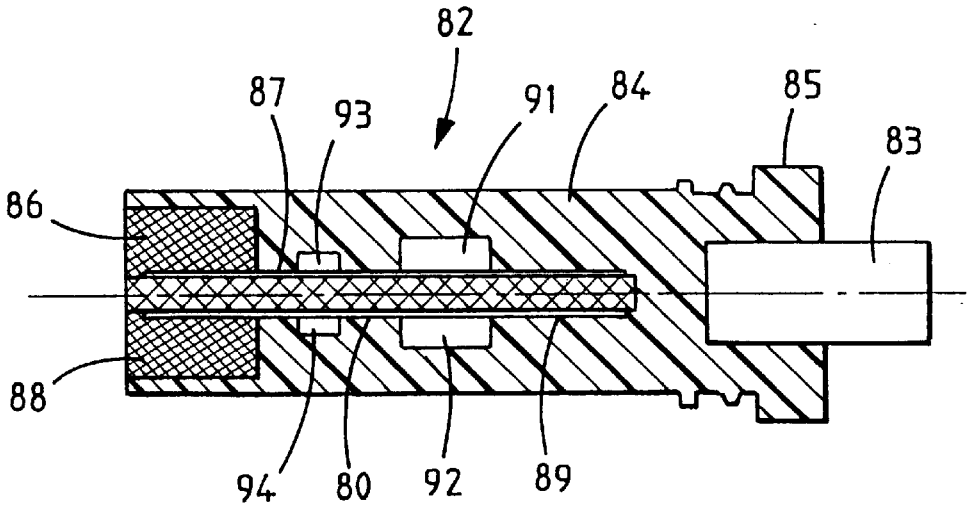
FIG. 8 is a sectional view through an initiator comprising two separate igniter heads, the thermosensitive charges of which are partially held in place by the overmoulding.

FIG. 8 depicts an initiator 82 which constitutes an alternative form of the initiator 2 just described. The initiator 82 is built around a circuit support 80 in the form of a thin parallelepipedal card. The essential difference between this initiator 82 and the initiator 2 described above lies in the fact that each of the two faces of the support 80 carries a complete printed circuit 87 or 89 connected to the same cable 83 bringing in electrical current. The support 80 is partially coated in a cylindrical overmoulding 84 which has a widened base 85 and which partially holds in place the thermosensitive charges 86 and 88 that constitute the igniter heads. In this embodiment, the initiator does not require a protective mask. Should current arrive via the cable 83, the two thermosensitive charges are fired simultaneously and the initiator 82 is thus highly effective in normal operation and extremely safe, both with respect to parasitic currents—thanks to its built-in electromagnetic protection 91, 93 or 92, 94, and with respect to possible misfires—thanks to the fact that the heads are duplicated.

What is claimed is:

1. An electro-pyrotechnic initiator suitable for use in igniting a pyrotechnic generator of gas for inflating an air bag, said initiator being connected to an electric cable comprising two conductive wires, said initiator comprising:

i) a thermosensitive charge carried by a heating resistive element consisting of a resistive strip and initiatable by said heating resistive element, ii) an electric circuit connecting said resistive element to said conductive wires, and iii) means of electromagnetically protecting said electric circuit, wherein said heating resistive element, said electric circuit and said means of electromagnetically protecting are integrated into a circuit of conductive strips which are joined to said conductive wires and which are formed on a printed circuit support which is in the form of a thin parallelepipedal card with two opposite flat faces, wherein each of the two opposite flat faces of said support carries a complete circuit of conductive strips, each said complete circuit including a heating resistive element covered by a thermosensitive charge and means of electromagnetic protection printed on each of the two opposite faces of the circuit support, and around which said initiator is built, said circuit support being partially coated with an overmoulded insulation.

* * * * *